US009506174B2

(12) United States Patent
Tseng

(10) Patent No.: US 9,506,174 B2
(45) Date of Patent: Nov. 29, 2016

(54) DIFFERENTIAL FEEDING MECHANISM FOR A SEWING MACHINE

(71) Applicant: Hsien-Chang Tseng, Taichung (TW)

(72) Inventor: Hsien-Chang Tseng, Taichung (TW)

( * ) Notice: Subject to any disclaimer, the term of this patent is extended or adjusted under 35 U.S.C. 154(b) by 100 days.

(21) Appl. No.: 14/564,020

(22) Filed: Dec. 8, 2014

(65) Prior Publication Data

US 2016/0160415 A1 Jun. 9, 2016

(51) Int. Cl.
*D05B 27/16* (2006.01)

(52) U.S. Cl.
CPC ..... *D05B 27/16* (2013.01)

(58) Field of Classification Search
CPC ..... D05B 27/16; D05B 27/00
See application file for complete search history.

(56) References Cited

U.S. PATENT DOCUMENTS 1,123,641 A * 1/1915 Woodward ..... D05B 27/02 112/312
1,506,916 A * 9/1924 Moffatt ..... D05B 35/08 112/132
RE17,229 E * 3/1929 Moffatt ..... D05B 27/02 112/312
2,228,220 A * 1/1941 Anton ..... D05B 27/02 112/312
3,202,121 A * 8/1965 Hans ..... D05B 27/08 112/313
3,611,817 A * 10/1971 Smith ..... D05B 27/08 112/313
3,995,571 A * 12/1976 Porter ..... D05B 27/04 112/311
4,027,609 A * 6/1977 Kerr ..... D05B 27/02 112/313
4,436,045 A * 3/1984 Bonham ..... D05B 27/08 112/313
4,527,497 A * 7/1985 Kerr ..... D05B 27/08 112/313
4,546,717 A * 10/1985 Marchesi ..... D05B 27/08 112/313
4,624,202 A * 11/1986 Alberti ..... D05B 27/08 112/313
4,748,839 A * 6/1988 von Hagen ..... D05B 27/08 112/313

* cited by examiner

*Primary Examiner* — Danny Worrell
(74) *Attorney, Agent, or Firm* — Bruce Stone LLP; Joseph A. Bruce

(57) ABSTRACT

A differential feeding mechanism for a sewing machine employs a differential mechanism to move first and second toothed bars. The differential mechanism includes a first link member to drive a first toothed bar, a second link member, and a third link member to drive a second toothed bar. The third link member is provided with an adjustment groove, in which being slidably disposed a slide member which can be adjusted in position with respect to the third link member. Adjusting the position of the slide member can change the fulcrum of the third link member and the swing amplitude of the two ends of the third link member, which consequently adjusts the differential feed of the first and second toothed bars.

9 Claims, 10 Drawing Sheets

DIFFERENTIAL FEEDING MECHANISM FOR A SEWING MACHINE

BACKGROUND OF THE INVENTION

Field of the Invention

The present invention relates to a feeding mechanism, and more particularly to a differential feeding mechanism for a sewing machine.

Description of the Prior Art

With the development of textile technology and diversification of fabric design, sewing machines have become diversified in terms of function and shape. For example, early sewing machines are provided with only one set of feed dogs (toothed bar) to feed fabric. Later on, sewing machines with two sets of feed dogs came into existence in order to meet different sewing requirements. The differential feed of the two sets of feed dogs allows to produce ruffles or to stretch the fabrics.

The present invention has arisen to mitigate and/or obviate the afore-described disadvantages.

SUMMARY OF THE INVENTION

The primary objective of the present invention is to provide a differential feeding mechanism for a sewing machine which is provided with two toothed bars, making it easy and quick to adjust the differential feed of the feeding mechanism.

To achieve the above objective, a differential feeding mechanism for a sewing machine in accordance with the present invention is disposed in a base which is provided with a main shaft rotated by a drive force source, a drive force of the main shaft is transmitted to a feeding device which is provided with a first toothed bar and a second toothed bar via a differential mechanism disposed in the base. The first and second toothed bars are driven by first and second feed members which are inserted into each other. The differential mechanism includes a first link member, a second link member and a third link member. The first link member is driven to move by the main shaft having two ends connected to one end of the second link member and one end of the third link member, respectively, so as to drive the first feed member to move back and forth and make the second link member swing, another end of the second connecting rod is pivotally connected to one end of the third connecting rod, and another end of the third connecting rod is pivoted to the second feed member to drive the second feed member to move back and forth. Between two ends of the third link member is formed an adjustment groove, and a slide member is movably disposed in the adjustment groove of the third link member. By adjusting the position of the slide member with respect to the third link member, different swing amplitudes can be produced when the third link member is driven to move by the second link member, so as to adjust feed rate difference between the first and second feed members and between the first and second toothed bars.

The present invention employs a differential mechanism to move the first and second toothed bars, and is able to adjust the fulcrum of the third link member of the first toothed bar by adjusting the position of the slide member, making it easy and quick to adjust the differential feed of the two toothed bars.

DETAILED DESCRIPTION OF THE PREFERRED EMBODIMENTS

Figure 1:
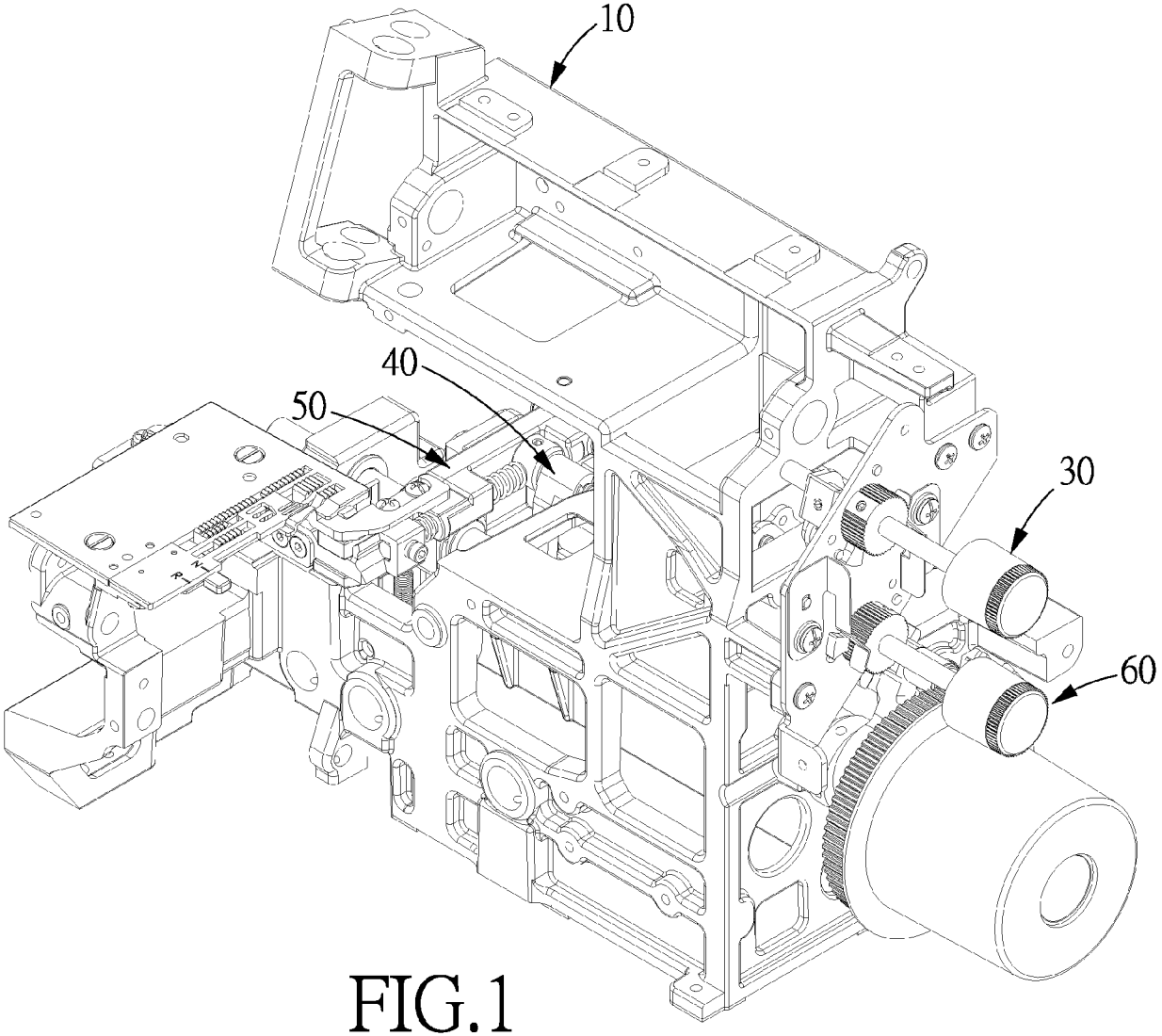
FIG. 1 is a perspective view of a differential feeding mechanism for a sewing machine in accordance with the present invention.
Figure 2:
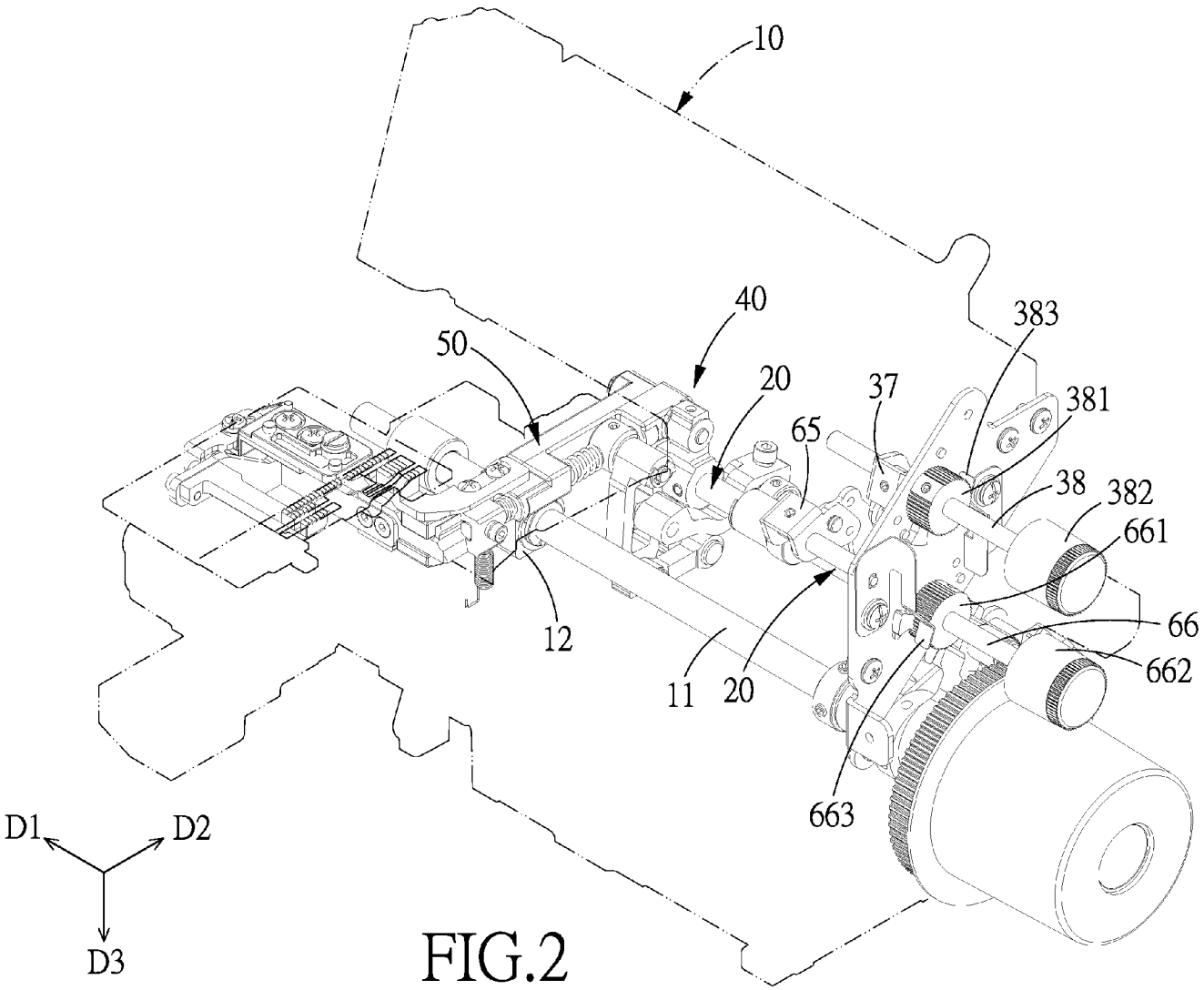
FIG. 2 shows a part of the differential feeding mechanism hidden in the sewing machine in accordance with the present invention.
Figure 3:
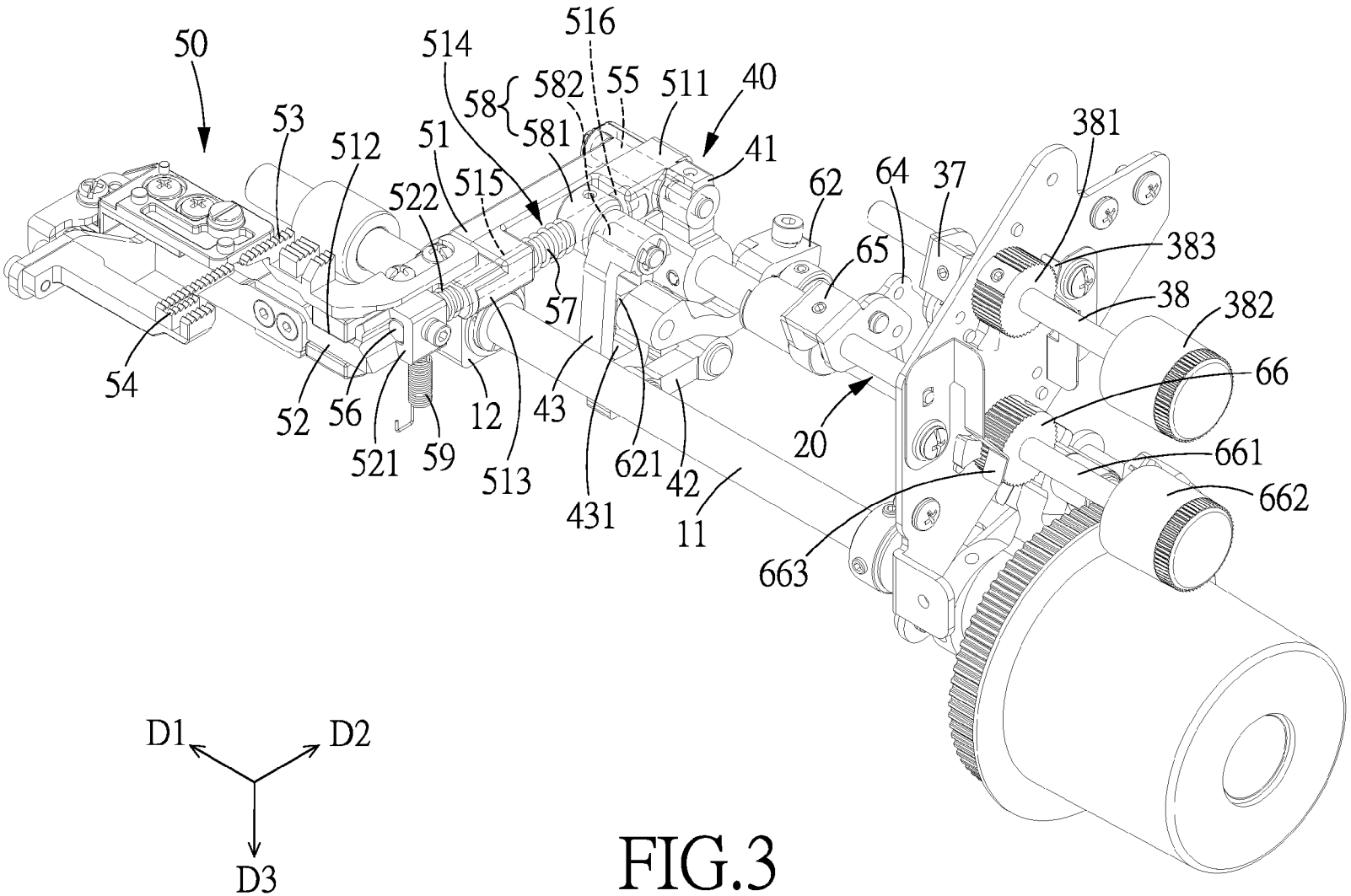
FIG. 3 is a perspective view showing the part of the differential feeding mechanism hidden in the sewing machine in accordance with the present invention.
Figure 4:
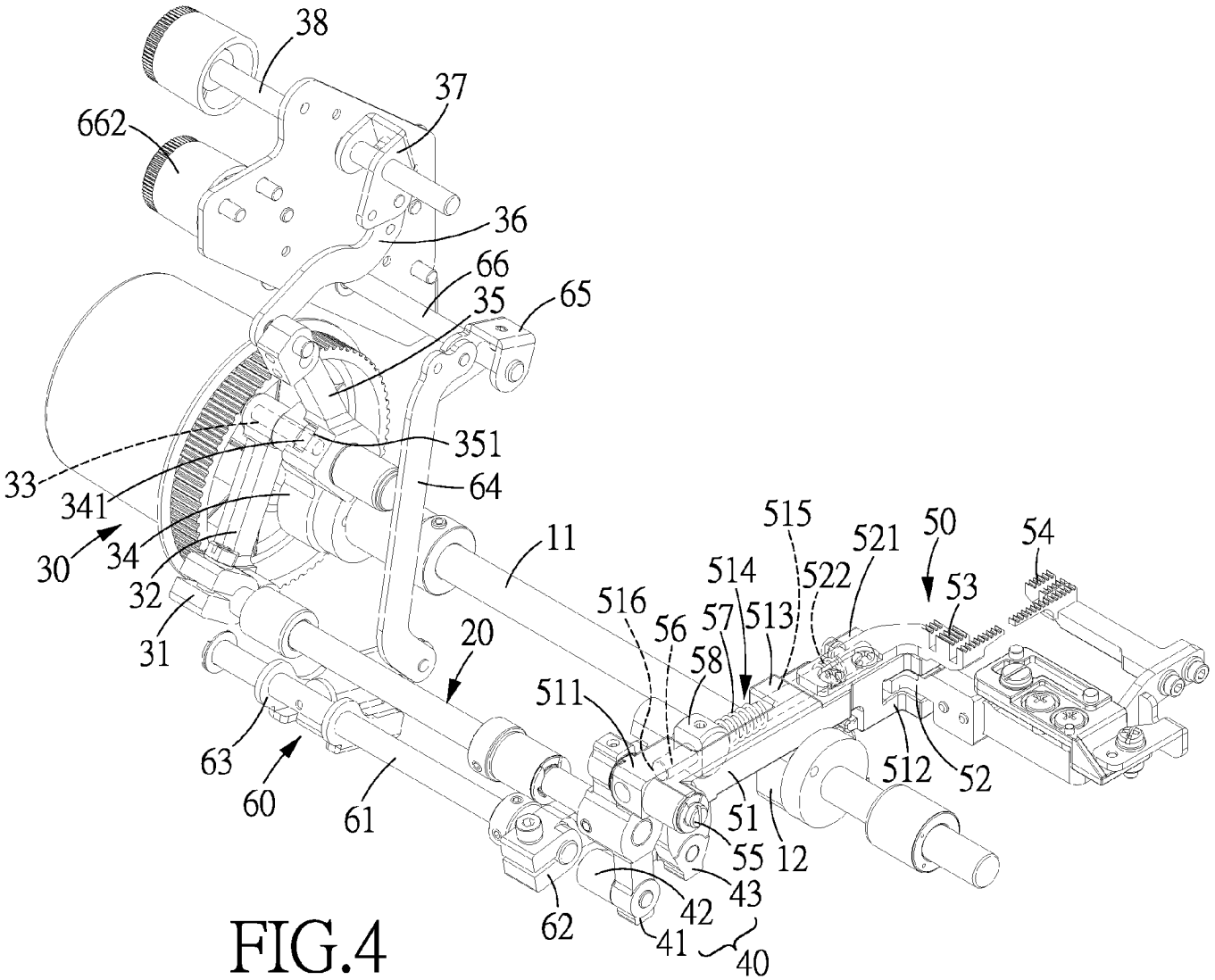
FIG. 4 is another perspective view showing the part of the differential feeding mechanism hidden in the sewing machine in accordance with the present invention.
Figure 5:
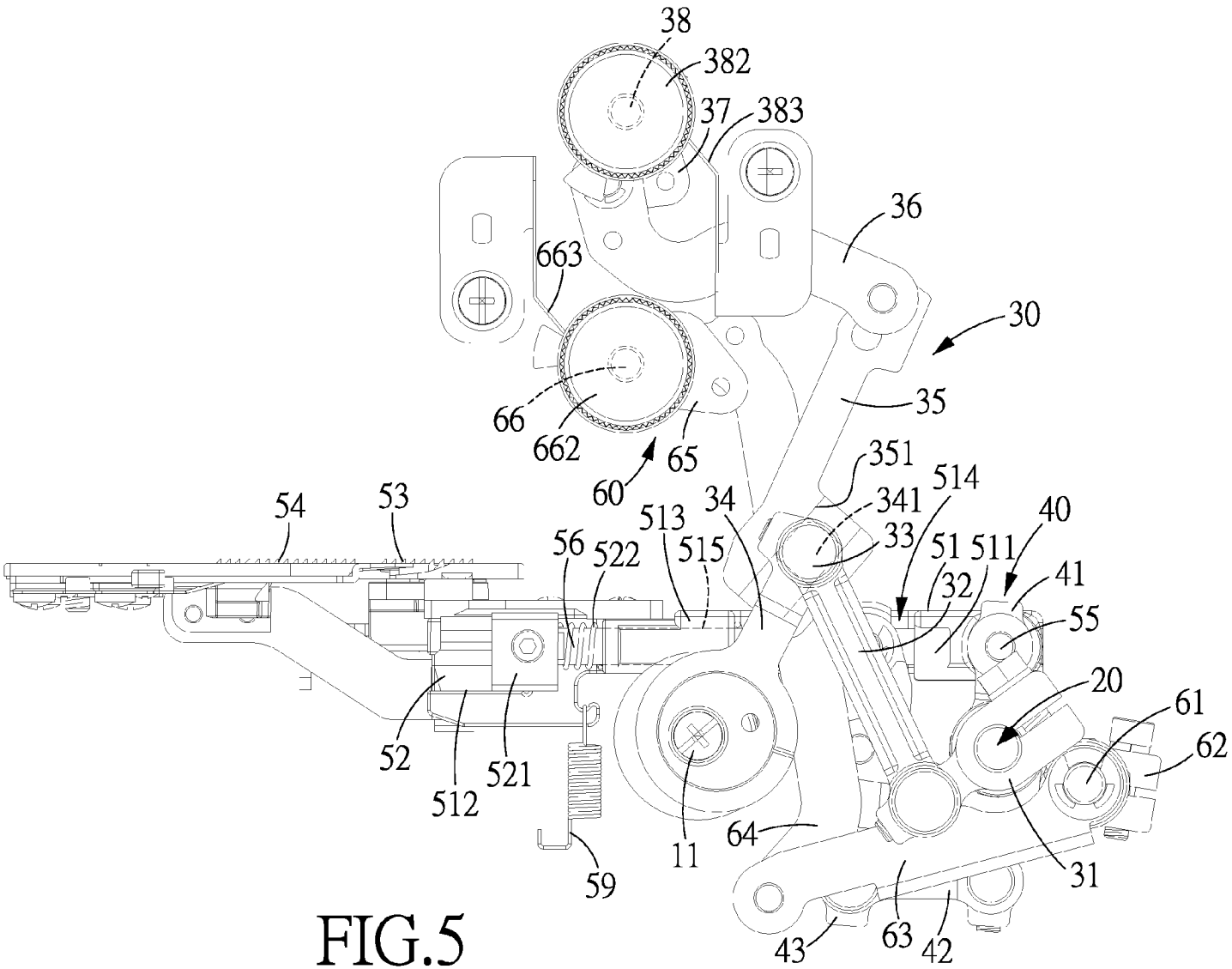
FIG. 5 is a side view showing the part of the differential feeding mechanism hidden in the sewing machine in accordance with the present invention.
Figure 6:
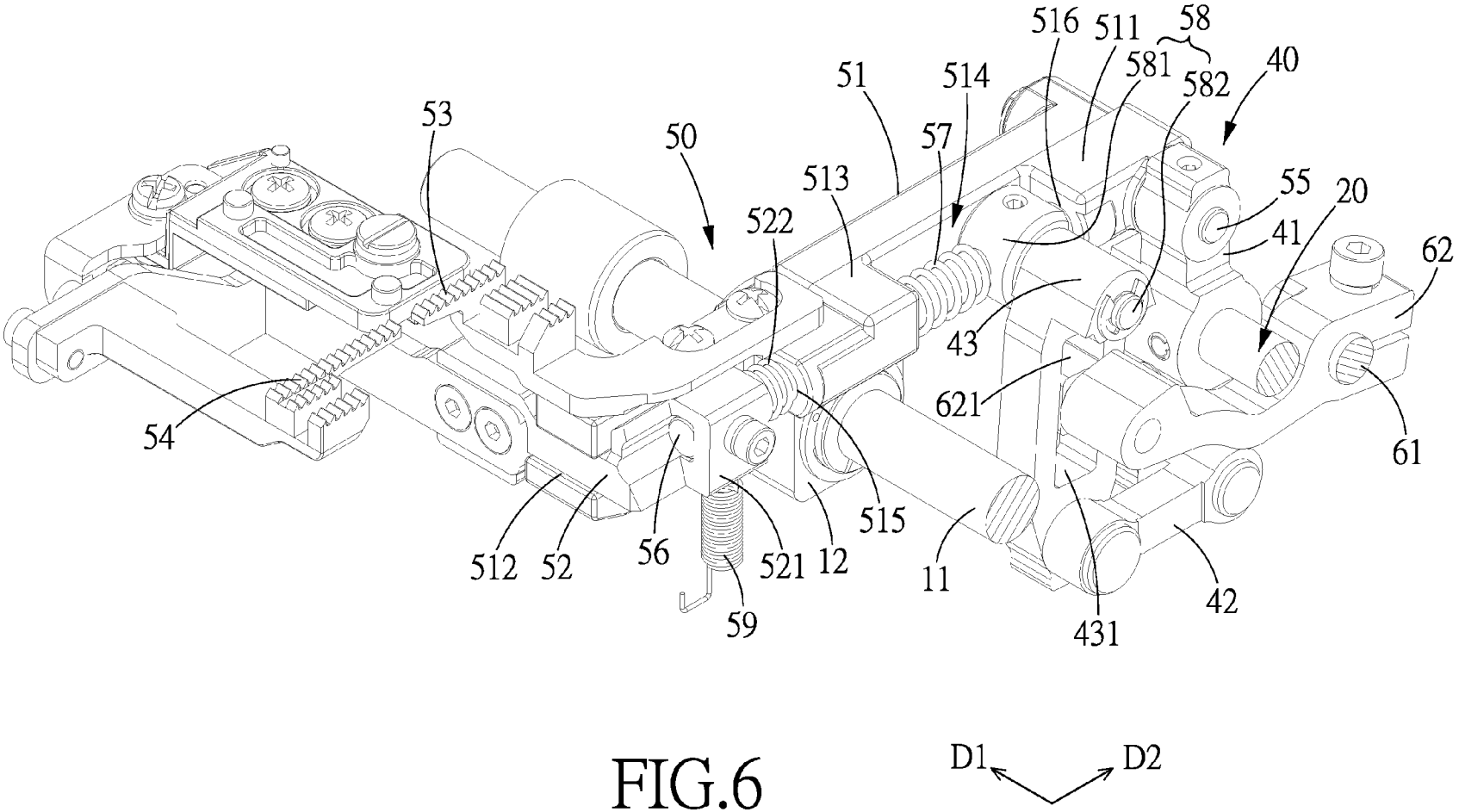
FIG. 6 is another view showing the part of the differential feeding mechanism hidden in the sewing machine in accordance with the present invention.

The present invention will be clearer from the following description when viewed together with the accompanying drawings, which show, for purpose of illustrations only, the preferred embodiment in accordance with the present invention.

Referring to FIGS. 1-12, a differential feeding mechanism for a sewing machine in accordance with a preferred embodiment of the present invention comprises: a base 10, a feeding swing rod 20, a feed adjustment device 30, a differential mechanism 40, a feeding device 50, and a differential adjustment device 60.

The base 10 is pivotally provided with a main shaft 11 which has one end extends out of the base 10 to connect a drive force source, and on the main shaft 11 is provided a mounting seat 12. A direction along which the main shaft 11 extends is defined as a first direction D1. A second direction D2 and a third direction D3 which are perpendicular to each other are defined as being perpendicular to the first direction D1.

The feeding swing rod 20 is pivotally disposed in the base 10 in a manner that the feeding swing rod 20 is rotatable along the first direction D1 and has one end extending out of the base 10.

The feed adjustment device 30 includes a first connecting rod 31, a second connecting rod 32, a tandem pivot 33, a third connecting rod 34, a fourth connecting rod 35, a fifth connecting rod 36 and a sixth connecting rod 37. The first connecting rod 31 has one end fixed to another end of the feeding swing rod 20, and another end pivotally connected to one end of the second connecting rod 32. Another end of the second connecting rod 32 is pivotally connected to one end of the third connecting rod 34 by the tandem pivot 33, and another end of the third connecting rod 34 is sleeved onto and rotated eccentrically by the main shaft 11. One end of the tandem pivot 33 extends out of the second and third connecting rods 32, 34, and pivotally provided with a slide block 341. The slide block 341 is movably disposed in a slide groove 351 of the fourth connecting rod 35. The fourth connecting rod 35 has one end formed with the slide groove 351 and pivotally connected to the base 10, and has another end pivotally connected to one end of the fifth connecting rod 36 which has another end pivoted to one end of the sixth connecting rod 37. Another end of the sixth connecting rod 37 is fixed to and driven to move by a width shaft 38 which has one end pivotally connected to the base 10, and at another end of the width shaft 38 are fixed a width adjustment toothed wheel 381 and a width adjustment knob 382. The width adjustment toothed wheel 381 is provided around the outer peripheral surface with a plurality of teeth. On the base 10 is provided an elastic restrict piece 383 with one end fixed to the base 10 and another end elastically engaged with the teeth of the width adjustment toothed wheel 381.

The differential mechanism 40 includes a first link member 41, a second link member 42 and a third link member 43. The first link member 41 has a middle section between two ends thereof fixed to the one end of the feeding swing rod 20 extending out of the base 10, so that the first link member 41 can be driven to move by the main shaft 11. The first link member 41 has one end pivotally connected to one end of the second link member 42 which has another end pivoted to one end of the third link member 43. The second link member 42 can be a U-shaped member for pivotally connecting the first and third link members 41, 43. When the first link member 41 swings, the second link member 42 will be caused to swing along with the first link member 41. Between two ends of the third link member 43 is formed an adjustment groove 431.

The feeding device 50 includes a first feed member 51, a second feed member 52, a first toothed bar 53 and a second toothed bar 54. The first feed member 51 includes a pivot portion 511 formed at one end, a clamping slot 512 at another end, an insertion portion 513 formed between the pivot portion 511 and the clamping slot 512, and an insertion space 514 formed between the pivot portion 511 and the insertion portion 513. The insertion portion 513 is formed with a passage 515 penetrating through the length of the insertion portion 513. The pivot portion 511 is provided with a positioning groove 516 aligned with the passage 515. The first feed member 51 is pivotally connected to the first link member 41 by a first pivot 55 which extends in the first direction D1 and is inserted in another end of the first link member 41 and the pivot portion 511. The first toothed bar 53 is fixed to the first feed member 51 which is slidably leaned against the mounting seat 12 of the main shaft 11. Two ends of the first pivot 55 are eccentric to each other, and the first link member 41 and the pivot portion 511 which are pivoted to each other by the two ends of the first pivot 55 are also eccentric to each other, so that rotating the first pivot 55 can change the positional relation between the first link member 41 and the pivot portion 511. Namely, micro-adjustment of the first link member 41 can change the location of the first feed member 51, enabling the first feed member 51 to have different start and end points of travel length. At one end of the first link member 41 is provided a bolt which is perpendicular to the first pivot 55 to fix the first pivot 55.

The second toothed bar 54 is fixed to the second feed member 52, and the second feed member 52 is slidably disposed in the clamping slot 512 of the first feed member 51 and movably in the second direction D2, so that the first and second toothed bars 53, 54 are moved by the first and second feed members 51, 52, respectively, which are inserted into each other. The second feed member 52 is fixed to one end of an insertion rod 56 by a fixing member 521 which is mounted on the second feed member 52. The insertion rod 56 extends along the second direction D2 and has another end inserted through the passage 515 and into the positioning groove 516. In this embodiment, the insertion rod 56 has a circular cross section. A first buffering member 57 and a pivot seat 58 are sleeved onto the insertion rod 56 and disposed in the insertion space 514 between the pivot portion 511 and the insertion portion 513. A second buffering member 522 is also sleeved onto the insertion rod 56 and located between the insertion portion 513 and the fixing member 521. A third buffering member 59 has two ends hooked to the fixing member 521 and the base 10, respectively, and the first, second and third buffering members 57, 522 and 59 are in the form a spring. The pivot seat 58 includes an insertion end 581 formed at one end thereof for insertion of the insertion rod 56, and a pivot shaft 582 extending in the first direction D1 is provided at another end of the pivot seat 58 and pivotally inserted in another end of the third link member 43.

The differential adjustment device 60 includes an adjustment shaft 61, an adjustment seat 62, a first drive member 63, a second drive member 64 and a third drive member 65. The adjustment shaft 61 is pivotally disposed on the base 10 and has one end extended out of the base 10 and fixed to one end of the adjustment seat 62. At another end of the adjustment seat 62 is disposed a slide member 621 which is movably disposed in the adjustment groove 431 of the third link member 43. The first drive member 63 has one end sleeved on the adjustment shaft 61, and another end pivotally connected to one end of the second drive member 64 which has another end pivoted to one end of the third drive member 65. Another end of the third drive member 65 is fixed to and driven to move by a differential shaft 66 which is pivotally disposed on the base 10. The differential shaft 66 has one end pivoted to the base 10, and at another end of the differential shaft 66 are fixed a differential adjustment toothed wheel 661 and a differential adjustment knob 662. The differential adjustment toothed wheel 661 is provided around the outer peripheral surface with a plurality of teeth. On the base 10 is provided another elastic restrict piece 663 with one end fixed to the base 10 and another elastically engaged with the teeth of the differential adjustment toothed wheel 661.

When in use, the drive force source drives the main shaft 11 to rotate, then the third connecting rod 34 is caused to swing, and then the second connecting rod 32 swings along with the third connecting rod 34. Then, the swing of the second connecting rod 32 causes rotation of the feeding swing rod 20. When the feeding swing rod 20 rotates, the two ends of the first link member 41 which is pivoted to the feeding swing rod 20 will swing in opposite directions, so that the one end of the first link member 41 connected to the second link member 42 drives the second link member 42 to move, and another end of the first link member 41 connected to the first feed member 51 drives the first feed member 51 to move, and as a result, the first feed member 51 drives the first toothed bar 53 to move.

The motion of the second link member 42 causes the one end of the third link member 43 to swing, and another end of the third link member 43 drives the insertion rod 56 to move horizontally via the pivot seat 58. Meanwhile, the insertion rod 56 drives the second feed member 52 to move, and the second feed member 52 moves the second toothed bar 54. By such arrangements, the first and second toothed bars 53, 54 are driven to move smoothly, and this is the process of how the main shaft 11 employs the differential mechanism 40 to transfer energy to the feeding device 50 which is provided with the first and second toothed bar 53,54.

Figure 7:
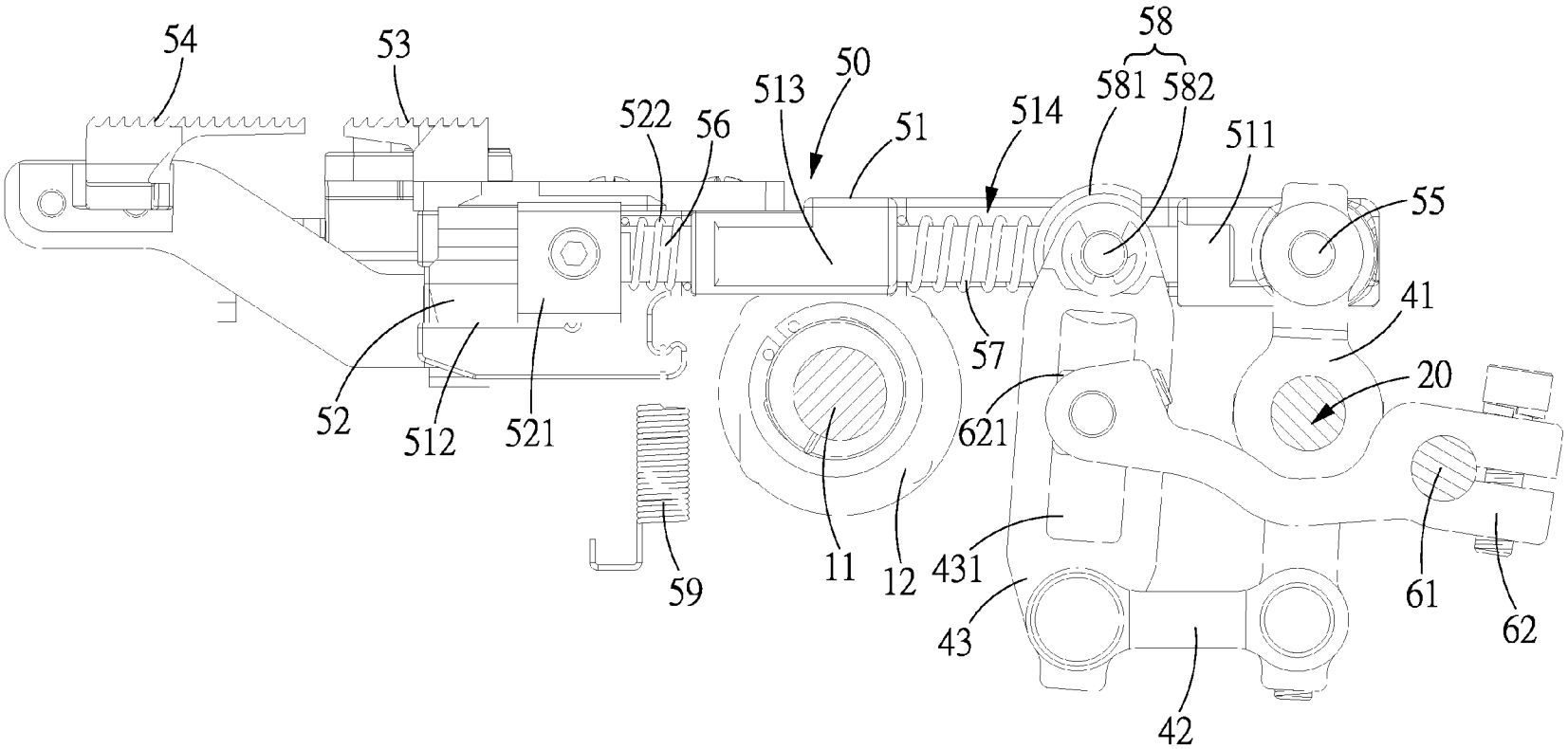
FIG. 7 is a cross sectional view showing the part of the differential feeding mechanism hidden in the sewing machine in accordance with the present invention.
Figure 8:
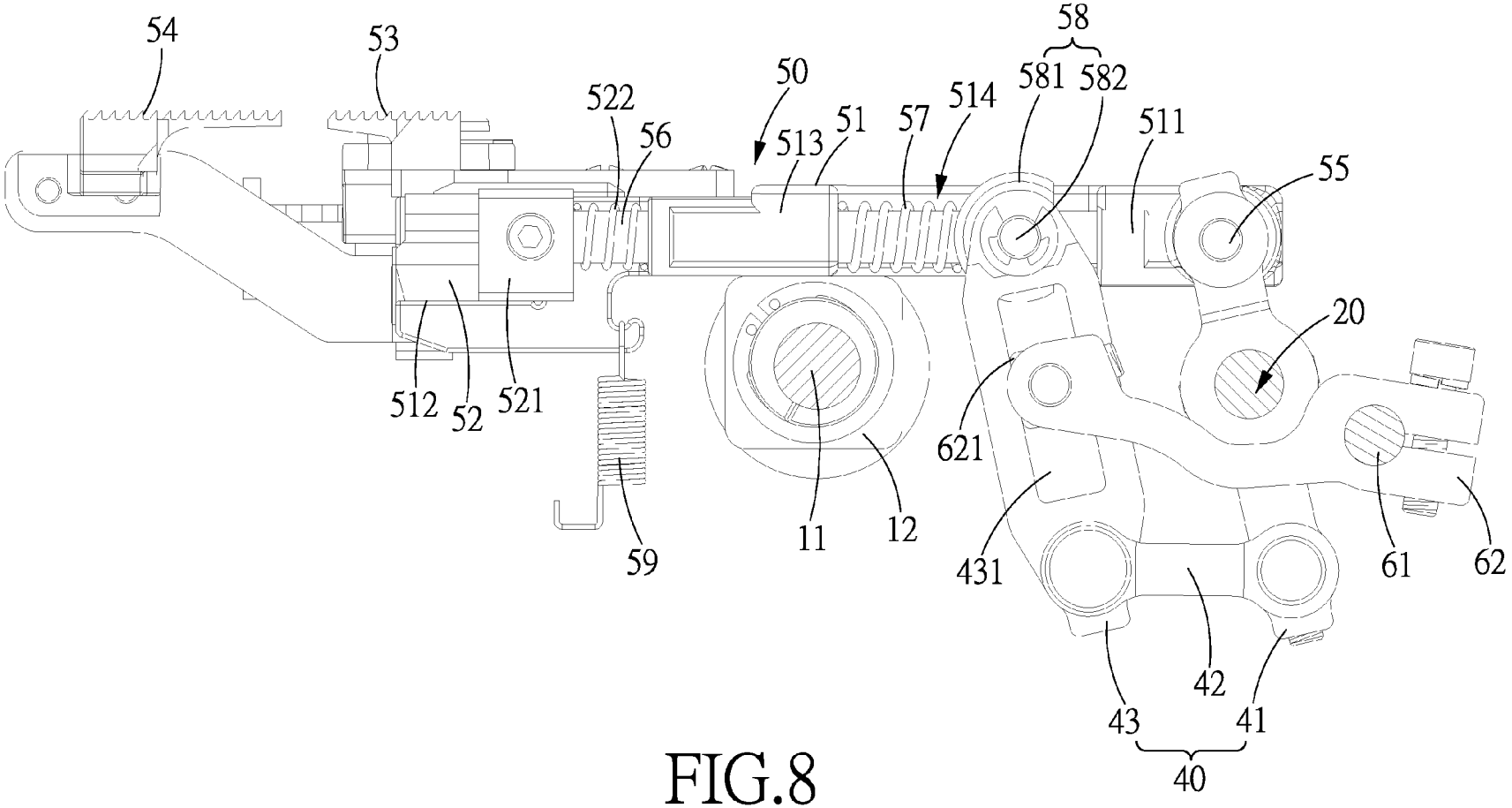
FIG. 8 is a cross sectional view of the present invention showing that the slide member is located at the center of the adjustment groove.

FIGS. 7 and 8 shows that the slide member 621 of the adjustment seat 62 is located at the center of the adjustment groove 431 of the third link member 43. At this moment, the two ends of the third link member 43 swing around the slide member 621 which serves as a fulcrum for the swing of the third link member 43, and the slide member 621 is equally distant to both ends of the third link member 43, as a result, the two ends of the third link member 43 have the same swing amplitude. By arrangements, the swing amplitude of the first link member 41 pivoted to the second link member 42 is also the same as that of the third link member 43, and the first and second feed members 51, 52 which are driven to move by the third and first link members 43, 41 will also be moved a corresponding distance. At this moment, there is almost no speed difference between the first and second toothed bars 53, 54.

To adjust the speed difference between the first and second toothed bars 53, 54, the differential adjustment knob 662 can be rotated to rotate the differential shaft 66, then the differential adjustment toothed wheel 661 on the differential shaft 66 rotates while the another elastic restrict piece 663 elastically presses against the differential shaft 66, which produces an easily sensible feeling of adjustment and sound, and the elastic restrict piece 663 can be selectively engaged with every each of the teeth of the differential adjustment toothed wheel 661, thus improving adjustment precision.

Figure 9:
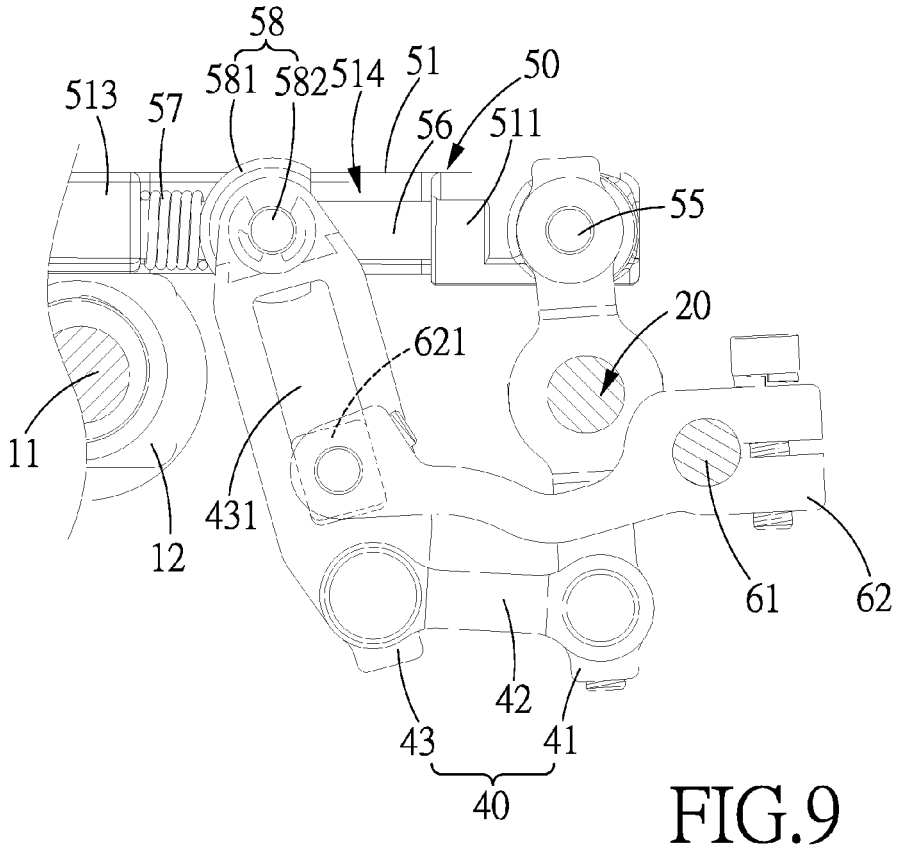
FIG. 9 is an operational view of FIG. 7.
Figure 10:
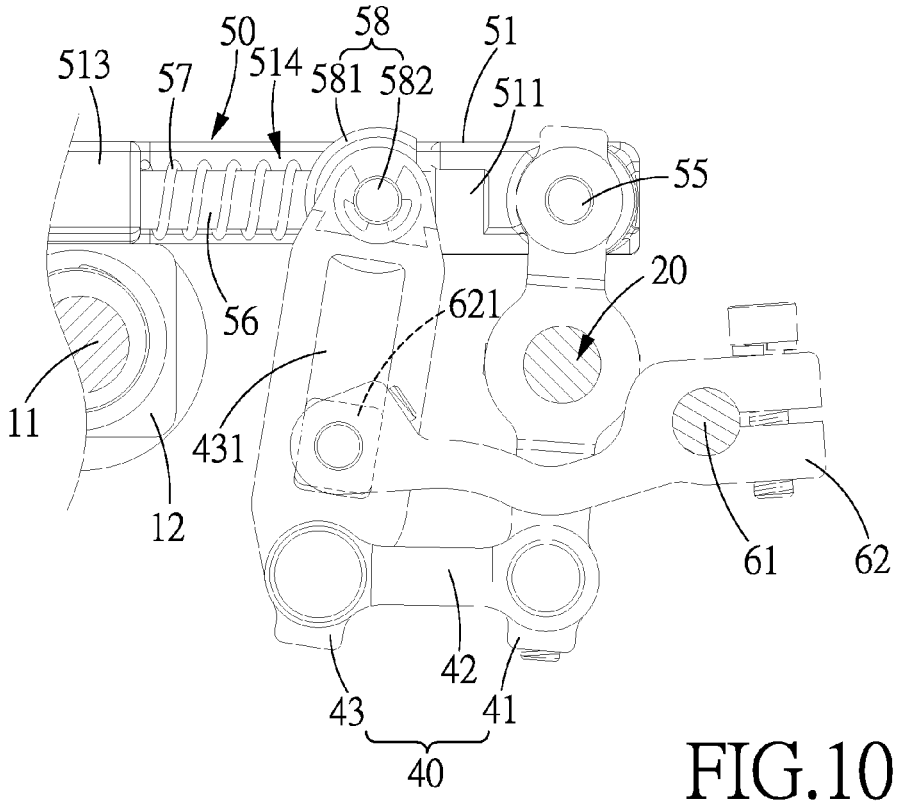
FIG. 10 is a cross sectional view of the present invention showing that the slide member moves in the adjustment groove to a position closest to the second link member.

When the differential shaft 66 rotates, the third drive member 65 will move the second drive member 64, then the second drive member 64 drives the first drive member 63, then the first drive member 63 rotates the adjustment shaft 61, then the adjustment seat 62 swings along with the rotation of the adjustment shaft 61. Then, the slide member 621 at another end of the adjustment seat 62 will slide within the adjustment groove 431 of the third link member 43. When the slide member 621 changes position in the adjustment groove 431, it means that the rotation fulcrum of the third link member 43 changes. When the slide member 621 moves in the adjustment groove 431 to a position closest to the second link member 42, as shown in FIGS. 9 and 10, the fulcrum of the third link member 43 will move downward, so that the end of the third link member 43 pivoted to the second link member 42 has a smaller swing amplitude than another end of the third link member 43 pivoted to the pivot seat 58. The distance that the second toothed bar 54 is moved by the insertion rod 56 and the second feed member 52 which are driven to move by the pivot seat 58 is larger than the distance that the first toothed bar 53 of the first feed member 51 is moved by the first link member 41 pivoted to the second link member 42, so as to form differential adjustment of the first and second toothed bars 53, 54.

Figure 11:
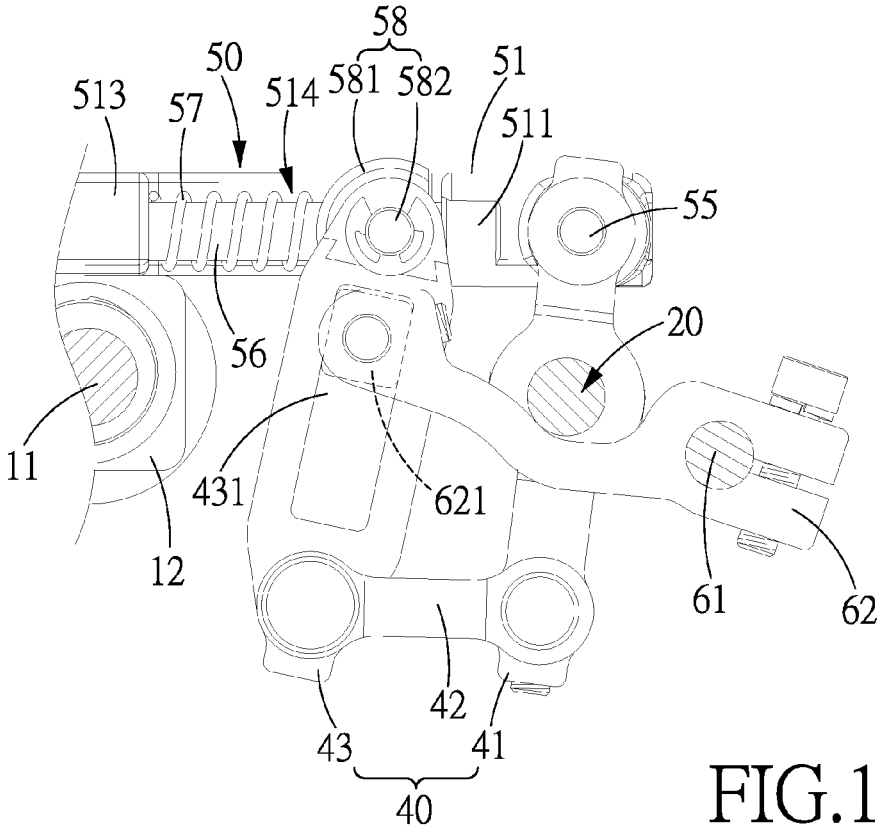
FIG. 11 is an operational view of FIG. 9.
Figure 12:
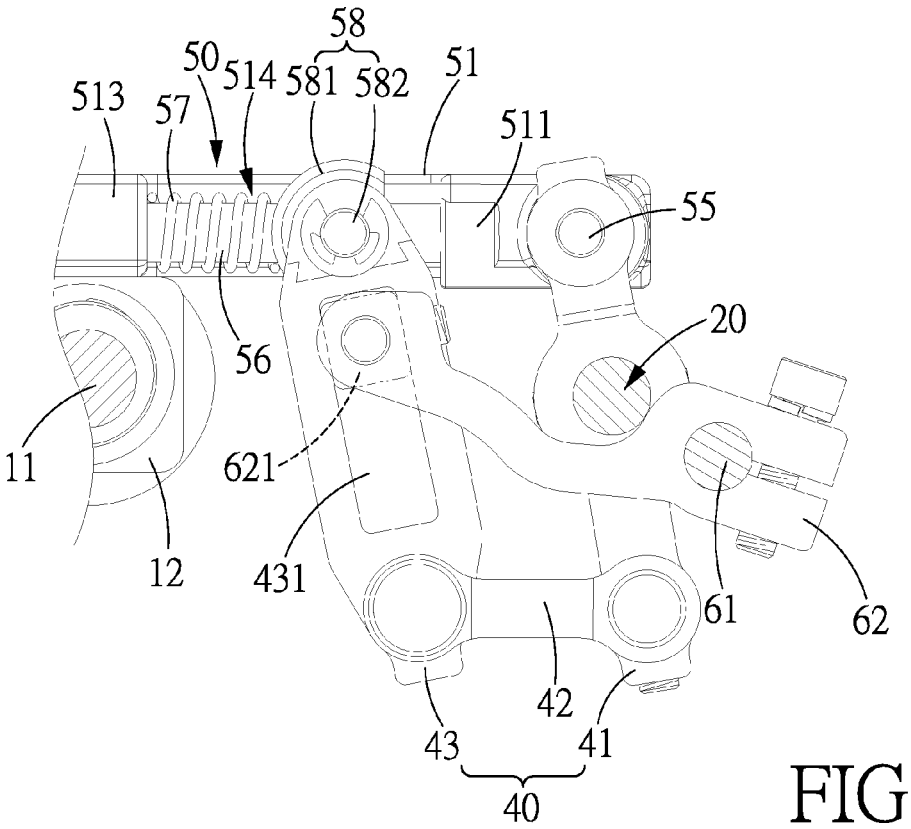
FIG. 12 is a cross sectional view of the present invention showing that the slide member moves in the adjustment groove to a position closest to the first feed member.

Contrarily, as shown in FIGS. 11 and 12, when the slide member 621 slides within the adjustment groove 431 to a position closest to the pivot seat 58, the fulcrum of the third link member 43 will move up, the end of the third link member 43 pivoted to the second link member 42 has a larger swing amplitude than another end of the third link member 43 pivoted to the pivot seat 58. The distance that the second toothed bar 54 is moved by the insertion rod 56 and the second feed member 52 which are driven to move by the pivot seat 58 is smaller than the distance that the first toothed bar 53 of the first feed member 51 is moved by the first link member 41 pivoted to the second link member 42, so as to form differential adjustment of the first and second toothed bars 53, 54.

Since the feed rate of the first and second toothed bars 53, 54 is controlled by the differential mechanism 40, to adjust the feed rate of the first and second toothed bars 53, 54, the width adjustment knob 382 can be rotated to rotate the width shaft 38, then the width adjustment toothed wheel 381 on the width shaft 38 rotates while the elastic restrict piece 383 elastically presses against the width shaft 38, which produces an easily sensible feeling of adjustment and sound, and the elastic restrict piece 383 can be selectively engaged with every each of the teeth of the width adjustment toothed wheel 381, thus preventing unlimited adjustment while improving adjustment precision.

When rotating, the width shaft 38 drives the sixth connecting rod 37 to swing, then the sixth connecting rod 37 makes the fifth connecting rod 36 swing, the fifth connecting rod 36 then makes the fourth connecting rod 35 pivot. When the fourth connecting rod 35 pivots, the position of the slide block 341 disposed in the slide groove 351 of the fourth connecting rod 35 also changes, and so does the position of the second connecting rod 32. Then, the first connecting rod 31 which is pivoted to the second connecting rod 32 to move the feeding swing rod 20 will be driven to change swing amplitude. By such arrangements, the swing amplitude of the feeding swing rod 20 is changed, and the movement distances of the first and second toothed bars 53, 54 are also changed, thus changing the feed rate.

In general, the present invention provides a feeding mechanism for a sewing machine with double toothed bars, wherein connecting rods allow the user to rotate the width adjustment knob 382 and the differential adjustment knob 662 so as to adjust feed rate and differential adjustment between the first and second toothed bars 53, 54. Therefore, the present invention provides an easy way of adjustment, making the feeding mechanism convenient to use.

While we have shown and described various embodiments in accordance with the present invention, it is clear to those skilled in the art that further embodiments may be made without departing from the scope of the present invention.

What is claimed is:

1. A differential feeding mechanism for a sewing machine being disposed in a base which is provided with a main shaft rotated by a drive force source, wherein the main shaft uses a differential mechanism disposed in the base to transmit a drive force generated by the drive force source to a feeding device which is provided with a first toothed bar and a second toothed bar, the first and second toothed bars being driven by a first feed member and a second feed member, the second feed member is slidably disposed in a clamping slot of the first feed member, the differential mechanism including a first link member, a second link member and a third link member, the first link member being driven to move by the main shaft having two ends connected to one end of the second link member and one end of the third link member, respectively, so as to drive the first feed member to move back and forth and make the second link member swing, another end of the second link member being pivotally connected to one end of the third link member, and another end of the third link member being pivoted to the second feed member to drive the second feed member to move back and forth, an adjustment groove being disposed between two ends of the third link member, a slide member being movably disposed in the adjustment groove of the third link member, changing the position of the slide member with respect to the third link member can make the another end of the third link member connected to the second feed member swing with an amplitude different from that of the first link member when the third link member is driven to move by the second link member, so as to adjust feed rate difference between the first and second feed members and between the first and second toothed bars.

2. The differential feeding mechanism for the sewing machine as claimed in claim 1, wherein a direction along which the main shaft extends is defined as a first direction, a second direction perpendicular to the first direction is defined as a second direction, the first feed member includes a pivot portion formed at one end, a clamping slot at another end, an insertion portion formed between the pivot portion and the clamping slot, and an insertion space formed between the pivot portion and the insertion portion, the insertion portion is formed with a passage, the pivot portion is provided with a positioning groove aligned with the passage, the first feed member is pivotally connected to the first link member by a first pivot which extends in the first direction and is inserted in another end of the first link member and the pivot portion, the first toothed bar is fixed to the first feed member which is slidably leaned against the mounting seat of the main shaft, two ends of the first pivot are eccentric to each other, so that a position relation between the two ends of the first link and the pivot portion is adjustable by rotating the first pivot;

the second toothed bar is fixed to the second feed member, and the second feed member is slidably disposed in the clamping slot of the first feed member and movably in the second direction, the second feed member is fixed to one end of an insertion rod by a fixing member which is mounted on the second feed member, the insertion rod extends along the second direction and has another end inserted through the passage and into the positioning groove, the insertion rod has a circular cross section, a pivot seat is sleeved onto the insertion rod and disposed in the insertion space between the pivot portion and the insertion portion, the pivot seat includes an insertion end formed at one end thereof for insertion of the insertion rod, and a pivot shaft extending in the first direction is provided at another end of the pivot seat and pivotally inserted in another end of the third link member.

3. The differential feeding mechanism for the sewing machine as claimed in claim 1, wherein a mounting seat is provided on the main shaft, the first feed member is slidably leaned against the mounting seat, the second feed member is fixed to the insertion rod by a fixing member, and a first buffering member and the pivot seat are sleeved onto the insertion rod and disposed in the insertion space between the pivot portion and the insertion portion.

4. The differential feeding mechanism for the sewing machine as claimed in claim 1, wherein the second feed member is fixed to the insertion rod by a fixing member, and a second buffering member is also sleeved onto the insertion rod and located between the insertion portion and the fixing member.

5. The differential feeding mechanism for the sewing machine as claimed in claim 1, wherein a feeding swing rod is pivotally disposed in the base and has one end extending out of the base, the first link member has a middle section between two ends thereof fixed to the one end of the feeding swing rod, a first connecting rod has one end fixed to another end of the feeding swing rod, and another end pivotally connected to one end of a second connecting rod, another end of the second connecting rod is pivotally connected to one end of a third connecting rod by the tandem pivot, and another end of the third connecting rod is sleeved onto and rotated eccentrically by the main shaft.

6. The differential feeding mechanism for the sewing machine as claimed in claim 5, wherein one end of the tandem pivot extends out of the second and third connecting rods and pivotally provided with a slide block, the slide block is movably disposed in a slide groove of a fourth connecting rod, the fourth connecting rod has one end formed with the slide groove and pivotally connected to the base, and has another end pivotally connected to one end of a fifth connecting rod which has another end pivoted to one end of a sixth connecting rod, another end of the sixth connecting rod is fixed to a width shaft which has one end pivotally connected to the base, and at another end of the width shaft are fixed a width adjustment knob.

7. The differential feeding mechanism for the sewing machine as claimed in claim 6, wherein a width adjustment toothed wheel is provided at the another end of the width shaft, the width adjustment toothed wheel is provided around the outer peripheral surface with a plurality of teeth, on the base is provided an elastic restrict piece with one end fixed to the base and another end elastically engaged with the teeth of the width adjustment toothed wheel.

8. The differential feeding mechanism for the sewing machine as claimed in claim 1 further comprising a differential adjustment device which includes an adjustment shaft, an adjustment seat, a first drive member, a second drive member and a third drive member, the adjustment shaft is pivotally disposed on the base and has one end fixed to one end of the adjustment seat, at another end of the adjustment seat is disposed the slide member, the first drive member has one end sleeved on the adjustment shaft, and another end pivotally connected to one end of the second drive member which has another end pivoted to one end of the third drive member, another end of the third drive member is fixed to a differential shaft which has one end pivoted to the base, and at another end of the differential shaft is fixed a differential adjustment knob.

9. The differential feeding mechanism for the sewing machine as claimed in claim 8, wherein the differential shaft is provided with a differential adjustment toothed wheel which is provided around an outer peripheral surface thereof with a plurality of teeth, on the base is provided another elastic restrict piece with one end fixed to the base and another end elastically engaged with the teeth of the differential adjustment toothed wheel.

* * * * *